US006891465B2

(12) United States Patent
Hatayama

(10) Patent No.: US 6,891,465 B2
(45) Date of Patent: May 10, 2005

(54) VARIABLE-RESISTANCE ELEMENT

(75) Inventor: Masato Hatayama, Miyagi-ken (JP)

(73) Assignee: Alps Electric Co., LTD, Tokyo (JP)

( * ) Notice: Subject to any disclaimer, the term of this patent is extended or adjusted under 35 U.S.C. 154(b) by 0 days.

(21) Appl. No.: 10/626,175

(22) Filed: Jul. 23, 2003

(65) Prior Publication Data

US 2004/0130432 A1 Jul. 8, 2004

(30) Foreign Application Priority Data

Aug. 12, 2002 (JP) ..... 2002-234285

(51) Int. Cl.[7] ..... H01C 10/38

(52) U.S. Cl. ..... 338/118; 338/160; 338/162; 338/176

(58) Field of Search ..... 338/118, 160, 338/162, 176

(56) References Cited

U.S. PATENT DOCUMENTS 3,673,539 A * 6/1972 Healy et al. ..... 338/154
4,345,236 A * 8/1982 Eichelberger et al. ..... 338/176
4,751,492 A * 6/1988 Tsuzuki et al. ..... 338/176
4,824,694 A * 4/1989 Bosze et al. ..... 427/102
5,111,178 A * 5/1992 Bosze ..... 338/160
5,475,359 A 12/1995 Hatayama et al.
6,172,595 B1 * 1/2001 Komatsu et al. ..... 338/160
6,507,271 B2 * 1/2003 Taguchi et al. ..... 338/308

FOREIGN PATENT DOCUMENTS

JP 3-233904 10/1991
JP 2001-6908 * 1/2001

* cited by examiner

*Primary Examiner*—Karl D. Easthom
(74) *Attorney, Agent, or Firm*—Beyer Weaver & Thomas LLP

(57) ABSTRACT

A variable-resistance element exhibiting high wear resistance and superior microlinearity includes a resistor constituted from a first resistive layer containing a first reinforcing material and a second resistive layer containing conductive carbon black and a second reinforcing material, the second resistive layer being disposed on the first resistive layer. The first reinforcing material is pulverized carbon fibers having an average particle size of 3 $\mu$m. The second reinforcing material is thermal black having an average particle size of 0.35 $\mu$m.

4 Claims, 10 Drawing Sheets

CARBON FIBER

10 μ

PULVERIZED CARBON FIBER

2 μ

LARGE PARTICLE SIZE
CARBON BLACK
(THERMAL BLACK)

0.5 μ

(PRIOR ART)

(PRIOR ART)

$V_A$: OUTPUT VALUE WHEN SLIDING CONTACT IS AT POINT A ON RESISTOR $V_B$: OUTPUT VALUE WHEN SLIDING CONTACT IS AT POINT B ON RESISTOR

Vin: VOLTAGE APPLIED IN DIRECTION OF LENGTH L OF RESISTOR $\Delta x$: DISTANCE BETWEEN POINTS A AND B

L: LENGTH OF RESISTOR $\alpha$: ARBITRARY SEGMENT

VARIABLE-RESISTANCE ELEMENT

BACKGROUND OF THE INVENTION

1. Field of the Invention

The present invention relates to a variable-resistance element (or device), the resistance of which is changed by a sliding contact moving on a surface of a resistor. In particular, it relates to a variable-resistance element having superior microlinearity.

2. Description of the Related Art

Variable-resistance elements having a sliding contact moving on a surface of a resistor require high wear resistance and longer operating life. Examples of conventional variable-resistance elements are disclosed in Japanese Unexamined Patent Application Publication No. 3-233904 and Japanese Patent No. 2889792 (corresponding to U.S. Pat. No. 5,475,359).

The variable-resistance element disclosed in Japanese Unexamined Patent Application Publication No. 3-233904 includes a resistor prepared by applying, by means of screen-printing, a resist paste composed of carbon black and carbon fibers dispersed in resin. Hard carbon fibers protruding from the surface of the resistor support the sliding contact, thereby preventing the resistor surface from becoming worn. The variable-resistance element disclosed in Japanese Patent No. 2889792 (corresponding to U.S. Pat. No. 5,475,359) has a resistor constituted from a lower resistor layer containing carbon fibers and an upper resistor layer composed of dispersed carbon black free of carbon fibers. A sliding contact of this variable-resistance element moves on the surface of the upper layer and is thereby prevented from becoming worn.

However, carbon fibers that constitute a resistor of a conventional variable-resistance element such as those described above are large, that is to say, they have a particle diameter in the range of 5 to 40 $\mu$m and a fiber length of 5 to 100 $\mu$m. Thus, the roughness of the surface of the resistor in terms of arithmetic average becomes larger, resulting in poor microlinearity. Microlinearity is an index that indicates the accuracy of variable-resistance elements.

FIG. 12 is a graph explaining microlinearity. The microlinearity is determined as follows. First, a sliding variable-resistance element having a sliding contact that can slide linearly with respect to the surface of the resistor is explained.

In the graph of FIG. 12, the ordinate indicates the output V of a sliding contact sliding on a resistor pattern when a rated voltage $V_{in}$ is applied in the direction of the length L of the sliding contact, and the abscissa indicates the position X of the sliding contact on the resistor pattern. Based on the assumption that the resistance of the resistor is constant irrespective of the position, the change in output when the sliding contact is moved from a certain point on the resistor by a distance $\Delta X$ must be indicated by an ideal line P having an inclination $V_{in}/L$.

According to the ideal line P, the change in normal output when the sliding contact is moved from the point A to the point B by the distance $\Delta X$ is represented by $\Delta V=(\Delta X/L)\times V_{in}$. However, the actual output S deviates from the ideal line P. As shown in equation (1) below, the microlinearity is determined by calculating the difference, i.e., $V_B-V_A$, between actual outputs $V_A$ and $V_B$ at the point A and the point B, respectively, determining the difference between $V_B-V_A$ and the normal output displacement, and obtaining the ratio of the calculated difference to the applied voltage as a percentage. The closer the microlinearity is to zero, the higher the accuracy. A position sensor that requires high performance shows superior microlinearity in which the actual output S is close to the ideal line P.

$$\text{Microlinearity} = \frac{(V_B - V_A) - \left(\frac{\Delta X}{L}\right)Vin}{Vin} \times 100 \tag{1}$$

wherein $V_A$ is the output value when the sliding contact is at the point A on the resistor;

$V_B$ is the output value when the sliding contact is at the point B on the resistor;

$V_{in}$ is the voltage applied in direction of the length L of the resistor;

$\Delta X$ is the distance between the points A and B; and

L is the length of the resistor.

Secondly, the microlinearity of a rotary variable-resistance element having a sliding contact rotatably attached to an arc-shaped resistor shown in FIG. 13 is determined by equation (2) below based on the same concept as that of the sliding variable-resistance element.

$$\text{Microlinearity} = \left(\frac{\Delta V}{Vin} - \frac{\Delta\theta}{\Theta}\right) \times 100 \tag{2}$$

wherein $V_{in}$ is the applied voltage;

$\Delta V$ is the difference in output voltage between the measurement points ($=V_B-V_A$);

$\Theta$ is the angle between electrodes; and $\Delta\theta$ is the difference between angles $\angle A$ and $\angle B$ (angle between the measurement points).

SUMMARY OF THE INVENTION

It is an object of the present invention to provide a variable-resistance element that achieves high wear resistance, longer operating lifetime, and superior microlinearity.

To achieve this object, the present invention provides a variable-resistance element including a resistor and a sliding contact that slides on a surface of the resistor, the resistor including a first resistor layer comprising carbon black and a first reinforcing material dispersed in a binder resin; and a second resistor layer comprising carbon black and a second reinforcing material dispersed in a binder resin, the second reinforcing material having a smaller average particle size than the first reinforcing material. Here, the second resistor layer is disposed on the first resistor layer.

Since the particles size of the reinforcing material contained in the upper resistor layer is smaller than that in the lower resistor layer, the surface of the resistor becomes smooth, thereby improving the microlinearity. The reinforcing material also improves the wear resistance of the surface of the resistor. Moreover the larger-particle first reinforcing material contained in the lower resistor layer increases the overall strength of the resistor.

Preferably, the average particle size of the second reinforcing material is not less than 0.1 $\mu$m but less than 1

When the average particle size of the second reinforcing material is less than 0.1 $\mu$m, its reinforcing effect is insufficient, and the sliding lifetime of the resistor surface decreases. When the average particle size is 1 $\mu$m or more, the microlinearity is degraded due to roughness of the resistor surface.

Preferably, such second reinforcing material is constituted from spherical particles to minimize the irregularities in the resistor surface and to improve both wear resistance and microlinearity.

Preferably, the content of the second reinforcing material in the second resistor layer is 5 to 30 percent by volume, and more preferably 7 to 25 percent by volume.

When the amount of the second reinforcing material is less than 5 percent by volume the second reinforcing material does not exhibit sufficient reinforcing effects. When the amount of the second reinforcing material exceeds 30 percent by volume, the resulting resistor paste is not suitable for application by printing; moreover, the resistor becomes fragile, resulting in degradation in wear resistance.

Preferably, the average particle size of the first reinforcing material is in the range of 1 to 10 $\mu$m.

When the average particle size of the first reinforcing material contained in the lower layer is less than 1 $\mu$m, the sliding lifetime is only the same as that of the second resistor layer (upper layer), thereby degrading the wear resistance. When the average particle size exceeds 10 $\mu$m, the roughness of the surface of the lower layer cannot be sufficiently covered by the second resistor layer formed thereon, resulting in poor microlinearity.

Preferably, the first reinforcing material is pulverized carbon fibers.

The pulverized carbon fibers in such a case are preferably fully pulverized until the fiber morphology is broken. When such pulverized carbon fibers are contained in the first resistor layer, the sliding lifetime of the resistor as a whole can be prolonged. Moreover, the surface of the resistor can be easily planarized by depositing the second resistor layer containing the second reinforcing material on the surface of the first resistor layer.

DESCRIPTION OF THE PREFERRED EMBODIMENTS

Figure 1:
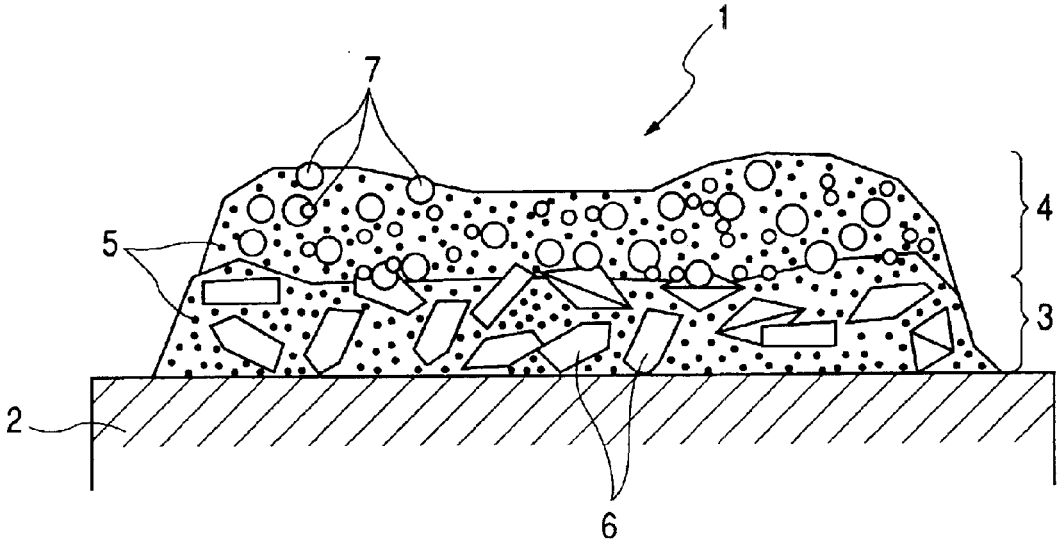
FIG. 1 is a cross-sectional view of a variable-resistance element of the present invention.
Figure 2:
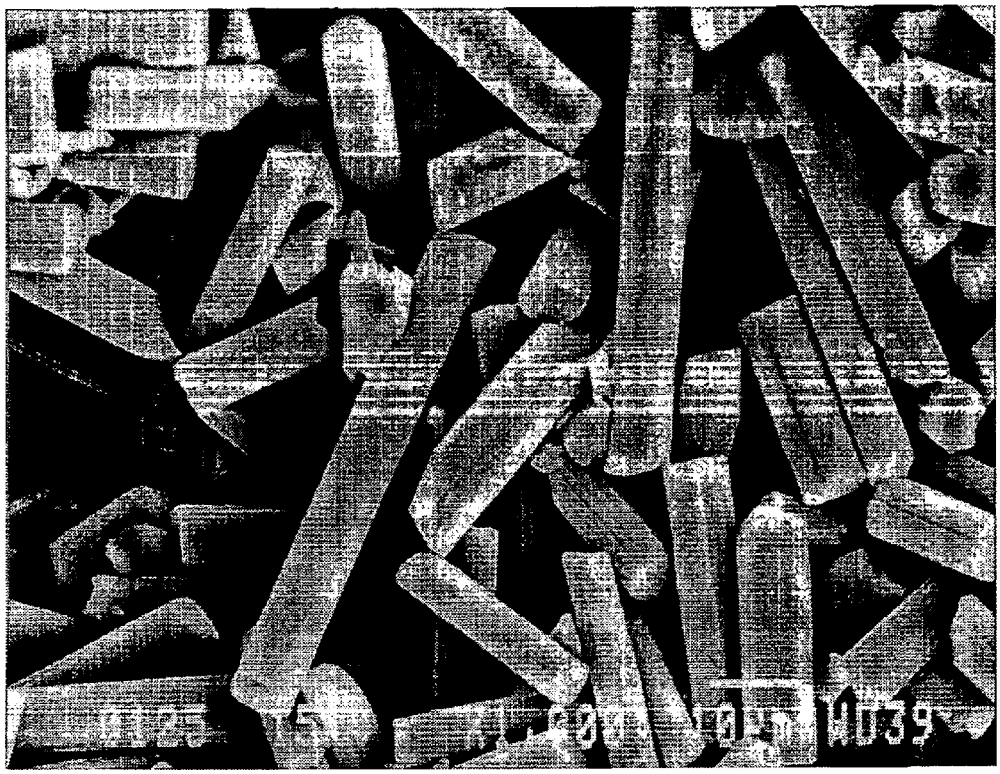
FIG. 2 is an electron micrograph of carbon fibers used to reinforce the resistor.
Figure 3:
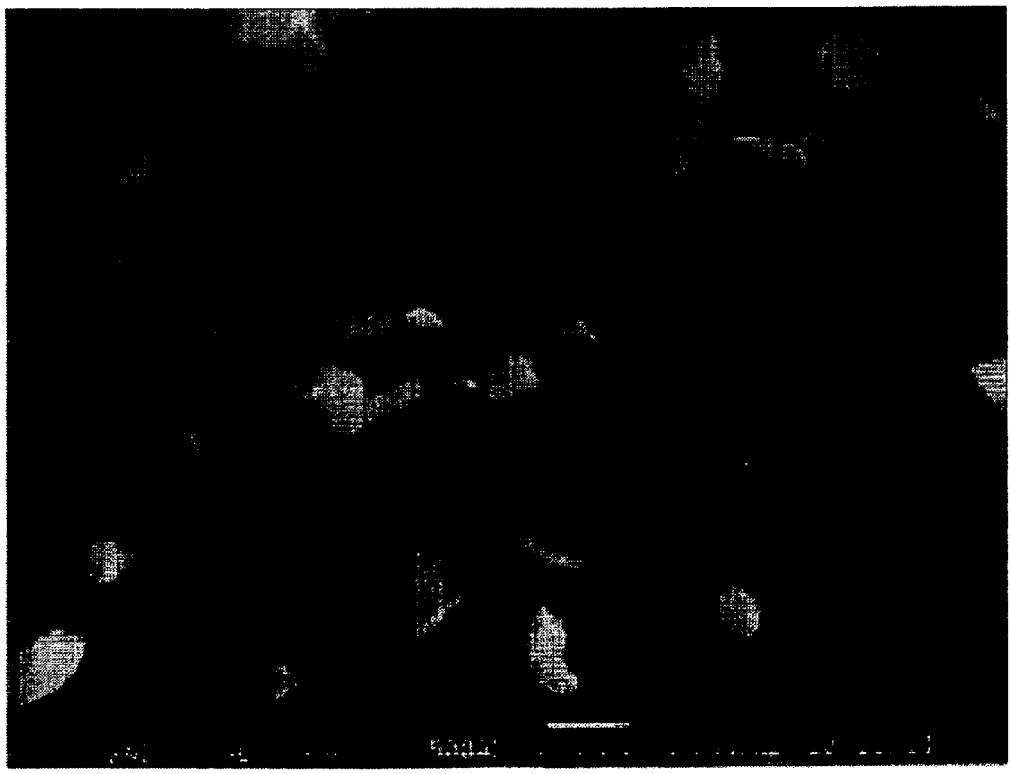
FIG. 3 is an electron micrograph of pulverized carbon fibers used to reinforce the resistor.
Figure 4:
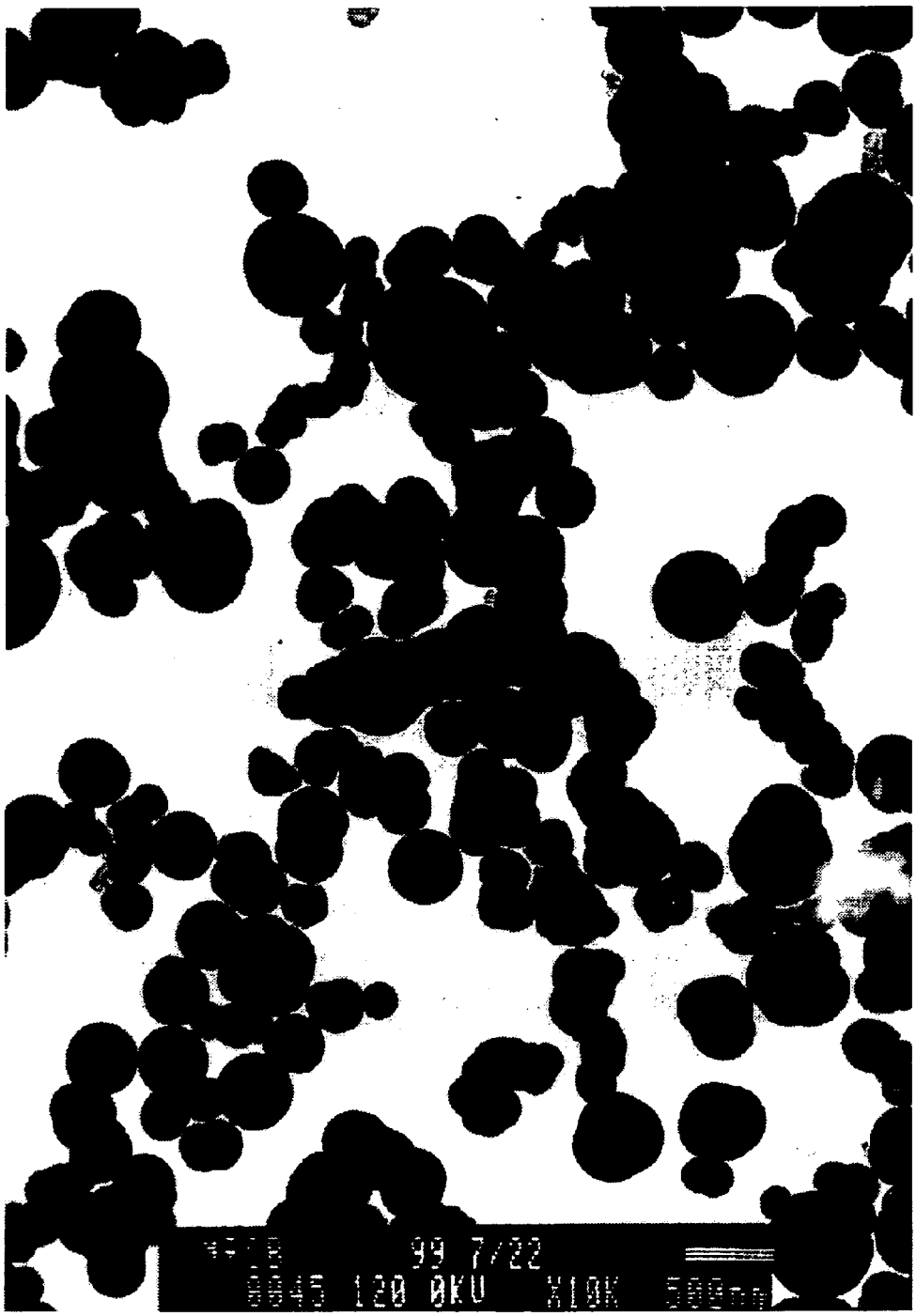
FIG. 4 is an electron micrograph of large particle size carbon black (thermal black) used to reinforce the resistor.

FIG. 1 is a cross-sectional view of a resistor of a variable-resistance element according to the present invention. FIG. 2 is an electron micrograph of carbon fibers used to reinforce the resistor. FIG. 3 is an electron micrograph of pulverized carbon fibers used to reinforce the resistor. FIG. 4 is an electron micrograph of large-particle-size carbon black (thermal black) used to reinforce the resistor.

As shown in FIG. 1, a resistor 1 has a two-layer structure constituted from a first resistive layer (lower layer) 3 formed on a surface of an insulating substrate 2 and a second resistive layer (upper layer) 4 formed on the first resistive layer 3. The first resistive layer 3 is prepared by dispersing a conductive material, i.e., carbon black 5, and a first reinforcing material 6 in a thermosetting binder resin. The second resistive layer 4 is prepared by dispersing a conductive material, i.e., the carbon black 5, and a second reinforcing material 7 in a binder resin of the same type.

The method for making the resistor 1 will now be described.

The resistor 1 is made using a first resistor paste for forming the first resistive layer 3 and a second resistor paste for forming the second resistive layer 4.

The first resistor paste is prepared by blending the conductive carbon black 5 and the first reinforcing material 6 with a thermosetting binder resin solution prepared using a predetermined solvent. The second resistor paste is prepared by blending the carbon black 5 and the second reinforcing material 7 with a thermosetting binder resin solution prepared using a predetermined solvent.

Nonlimiting examples of the binder resins for making the first and second resistor pastes include phenol formaldehyde resins, xylene-modified phenol resins, epoxy resins, polyimide resins, melanin resins, acrylic resins, acrylate resins, and furfryl resins. Any other resin soluble in the solvent described below may be used.

Any solvent that can dissolve the binder resins described above may be used. Examples thereof include glycols, esters, and ethers used either alone or in combination.

Preferable examples of the first reinforcing material 6 include commercially available milled carbon fibers shown in FIG. 2, and pulverized carbon fibers prepared by pulverizing chopped carbon fibers to an average particle diameter of 1 to 10 $\mu$m, as shown in FIG. 3.

The second reinforcing material 7 is preferably spherical particles having an average particle size of at least 0.1 $\mu$m but less than 1 $\mu$m, as determined by 1 electronmicroscopy. Examples of the spherical particles include conductive particles such as large-particle-size carbon black (thermal black) shown in FIG. 4 and glassy carbon, and inorganic fillers such as silica particles and alumina particles.

Addition of the second reinforcing material 7 increases the operating life of the resistor 1 while minimizing adverse effects on the surface roughness of the resistor 1. The thermal black used as the second reinforcing material 7 has superior dispersibility in the binder resin. Since the thermal black is conductive, the thermal black rarely increases the contact resistance between the sliding contact and the resistor 1.

Examples of the carbon black 5 include acetylene black, furnace black, and channel black. In particular, acetylene black is preferred since it has a well-developed branch structure and thus has a reinforcing effect, and since it decreases the change in resistance of the resistor 1 over time.

Each of the above materials is weighed and mixed together by a dispersion mixer to prepare each of the first and second resistor pastes.

The resistive pastes prepared as above will now be applied by means of conventional screen-printing. First, electrodes are formed at positions corresponding to the two ends of the resistive layers to be formed. The electrodes are formed by applying a conventional conductive paste containing silver or the like on the insulating substrate 2, removing the solvent by drying, and curing the binder resin by heating. Next, the first resistor paste is applied by printing to cover the conductive patterns composed of silver and the like, the solvent is removed by drying, and the binder resin is cured by heat to form the first resistive layer 3, i.e., the lower layer. The second resistor paste is then applied on the first resistive layer 3 by printing, is dried, and is heated to form the second resistive layer 4, i.e., the upper layer.

A 400 to 100-mesh screen is used in the above screen-printing, depending on the thickness of the resistive layer after curing. The order of performing drying and curing is not limited to that described above. The curing step after application of the first resistor paste for forming the first resistive layer 3 may be omitted. In such a case, the first resistor paste is cured in the same step of curing the second resistor paste for forming the second resistive layer 4.

The resistor 1 may be arc-shaped or strip-shaped. When the resistor 1 is arc-shaped, the sliding contact is rotatably attached to the substrate to form a rotary variable-resistance element. When the resistor 1 is strip-shaped, the sliding contact is slidably attached to the substrate to form a sliding variable-resistance element.

The sliding contact (not shown) is composed of noble metal that can maintain good contact with the resistor 1 for a long time. In particular, the sliding contact may be composed of gold- or silver-plated nickel silver, or an alloy of palladium, silver, platinum, or gold. Preferably, a noble metal alloy is used to maintain a stable contact when prevention of surface oxidation at high temperature is particularly desired.

In the variable-resistance element having the resistor 1, the wear resistance of the surface of the resistor 1 can be improved since the coarser reinforcing material is contained in the lower resistive layer. Since the particle size of the reinforcing material contained in the upper resistive layer is smaller than that of the lower layer, the surface of the resistor 1 becomes smooth, thereby achieving superior microlinearity.

The microlinearity and the wear resistance were examined as described below using a plurality of examples and comparative examples of the resistors.

EXAMPLE

Example 1

The first resistor paste and the second resistor paste were prepared according to the compositions shown in Tables 1 and 2 below.

TABLE 1

First Resistor Paste

| Component | Material | Weight [g] | Particle size [μm] |
|---|---|---|---|
| Binder resin | Phenolic resin | 387 | — |
| Conductive material | Carbon black (acetylene black) | 93 | 0.04 |
| First reinforcing material 6 | Pulverized carbon fibers | 126 | 3 |
| Solvent | Carbitol | 394 | — |

TABLE 2

Second Resistor Paste

| Component | Material | Weight [g] | Particle size [μm] |
|---|---|---|---|
| Binder resin | Phenolic resin | 433 | — |
| Conductive material | Carbon black (acetylene black) | 73 | 0.04 |
| Second reinforcing material 7 | Thermal black | 81 | 0.35 |
| Solvent | Carbitol | 413 | — |

The first resistor paste for forming the first resistive layer 3 was applied, by printing using a screen of an appropriate mesh, on an epoxy glass insulating substrate 2 having silver electrodes preliminarily formed thereon. The applied paste was dried to form the first resistive layer 3. The second resistor paste for forming the second resistive layer 4 was then applied on the first resistive layer 3. The applied paste was dried and was cured at 240° C. for 10 minutes to prepare the resistor 1 shown in FIG. 1.

The carbon black (acetylene black) was used to render conductivity. Unlike the first reinforcing material 6 and the second reinforcing material 7, the carbon black is extremely fine, i.e., 0.04 μm in average particle size.

The average particle size (3 μm) of the pulverized carbon fibers used as the first reinforcing material 6 is indicated in terms of arithmetic average particle size according to Japanese Industrial Standard (JIS) Z-8819 calculated from the results obtained by laser diffractometry defined in JIS-Z-8825. The average particle size (0.35 μm) of the thermal black used as the second reinforcing material 7 is determined by electronmicroscopy.

Example 2

A resistor of Example 2 was prepared as in Example 1 except that the thermal black (average particle size: 0.35 μm) used as the second reinforcing material 7 of the second resistor paste shown in Table 2 was replaced with 81 grams of carbon black having an average particle size of 0.12 μm.

Example 3

A resistor of Example 3 was prepared as in Example 1 except that the thermal black (average particle size: 0.35 μm) used as the second reinforcing material 7 of the second resistor paste shown in Table 2 was replaced with 81 grams of pulverized carbon black having an average particle size of 0.90 μm (measured by laser diffractometry).

Example 4

A resistor of Example 4 was prepared as in Example 1 except that the pulverized carbon fibers (average particle size: 3 μm) used as the first reinforcing material 6 of the first resistor paste shown in Table 1 were replaced with pulverized carbon fibers having an average particle size of 7 μm (measured by laser diffractometry).

Example 5

A resistor of Example 5 was prepared as in Example 1 except that the thermal black (average particle size: 0.35 μm) used as the second reinforcing material 7 of the second resistor paste shown in Table 2 was replaced with titanium oxide having an average particle size of 0.4 μm (measured by electronmicroscopy).

Example 6

A resistor of Example 6 was prepared as in Example 1 except that the pulverized carbon fibers (average particle size: 3 μm) used as the first reinforcing material 6 of the first resistor paste shown in Table 1 were replaced with pulverized carbon fibers having an average particle size of 0.90 μm (measured by laser diffractometry).

Comparative examples of the resistors are now explained. FIGS. 5 to 8 are cross-sectional views of resistors of Comparative Examples 1 to 4, respectively.

Comparative Example 1

Figure 5:
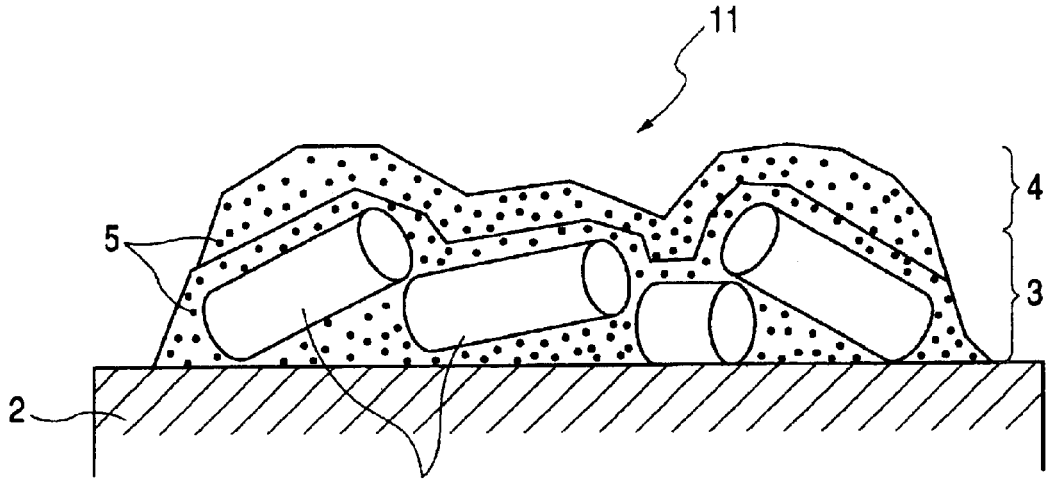
FIG. 5 is a cross-sectional view of a resistor of Comparative Example 1.

A resistor 11 of Comparative Example 1 is shown in FIG. 5. The resistor 11 was prepared as in Example 1 except that the pulverized carbon fibers (average particle size: 3 μm) used as the first reinforcing material 6 of the first resistor paste shown in Table 1 was replaced with carbon fibers 12 having an average diameter of 8 μm and an average fiber length of 30 μm and that the thermal black (average particle size: 0.35 μm) used in Example 1 as the second reinforcing material 7 of the second resistor paste shown in Table 2 was not used in Comparative Example 1.

Comparative Example 2

Figure 6:
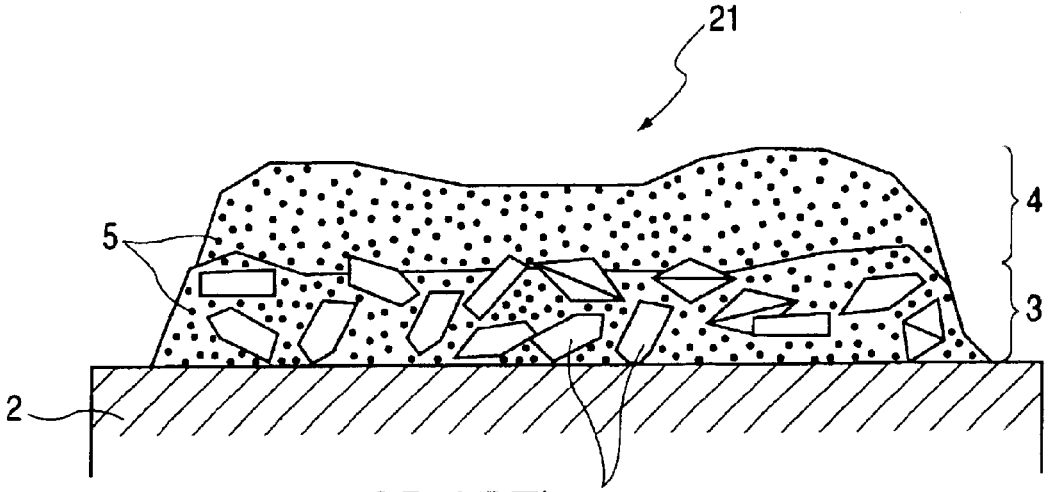
(PRIOR ART) FIG. 6
FIG. 6 is a cross-sectional view of a resistor of Comparative Example 2.

A resistor 21 of Comparative Example 2 is shown in FIG. 6. The resistor 21 was prepared as in Example 1 except that the thermal black (average particle size: 0.35 μm) used in Example 1 as the second reinforcing material 7 of the second resistor paste shown in Table 2 was not used.

Comparative Example 3

Figure 7:
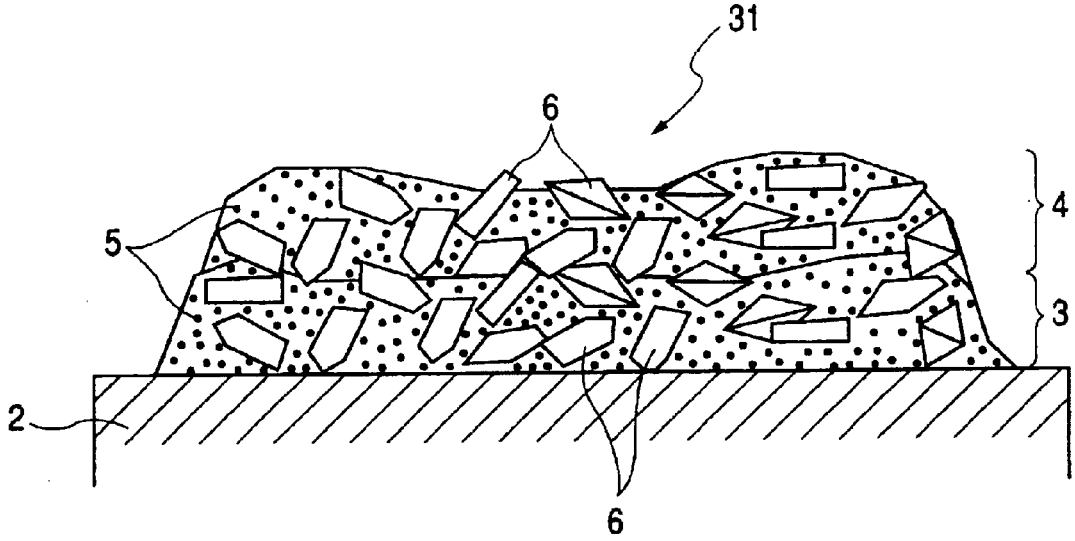
FIG. 7 is a cross-sectional view of a resistor of Comparative Example 3.

A resistor 31 of Comparative Example 3 is shown in FIG. 7. The resistor 31 was prepared as in Example 1 except that the same first resistor paste was applied on the first resistive layer 3 composed of the first resistor paste shown in Table 1 to make the lower layer and the upper layer composed of the first resistor paste.

Comparative Example 4

Figure 8:
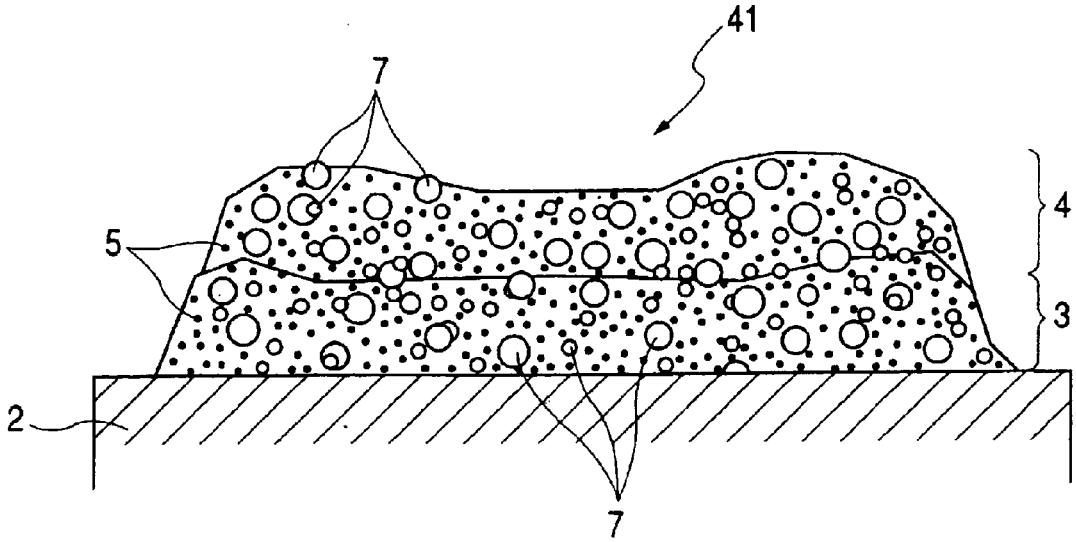
(PRIOR ART) FIG. 8
FIG. 8 is a cross-sectional view of a resistor of Comparative Example 4.

A resistor 41 of Comparative Example 4 is shown in FIG. 8. The resistor 41 was prepared as in Example 1 except that the first resistive layer 3 was formed by applying the second resistor paste shown in Table 2 by means of printing, and the same second resistor paste was applied on the first resistive layer 3 by means of printing to form the second resistive layer 4.

Measurement and Testing of Resistors

Figure 13:
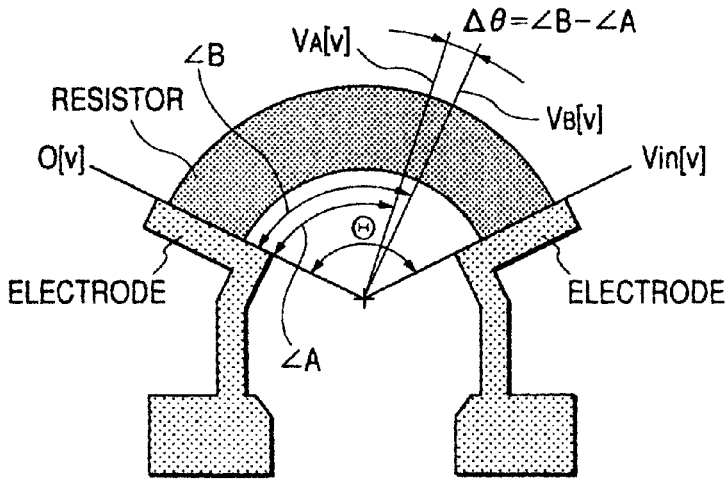
FIG. 13 is a diagram that explains the microlinearity of a rotary variable-resistance element.

The surface roughness (arithmetic average surface roughness Ra) of each of the resistors of Examples 1 to 6 and Comparative Examples 1 to 4 was determined. After the initial measurement of microlinearity, sliding lifetime test was performed for each resistor. In the measurement and testing below, a rotary variable-resistance element in which a sliding contact moved on a surface of an arc-shaped resistor (see FIG. 13) was used.

Measurement and Testing Methods

The surface roughness of the resistor was measured using a commercially available contact-type surface roughness/contour measuring instrument (Surface Texture and Contour Measuring Instrument SURFCOM 200C, manufactured by Tokyo Seimitsu Co., Ltd.).

The arithmetic average surface roughness Ra as defined in JIS B 0601-1982 was used. The cutoff was 0.25 mm. Operating life testing, i.e., sliding lifetime testing, was performed for each of Examples and Comparative Examples. In the testing, the sliding contact was composed of an alloy or Pt, Ag, Pd, and Cu, was 0.07 mm in thickness, and had eight contact points 0.35 mm in width. The overall contact load was 0.274 N (28 gf).

In the testing, the sliding contact was attached to the resistor to make a variable-resistance element. After sliding the sliding contact for fifty million times, the state of wear of the resistor was determined by the surface roughness/contour measuring instrument.

Results

Figure 9:
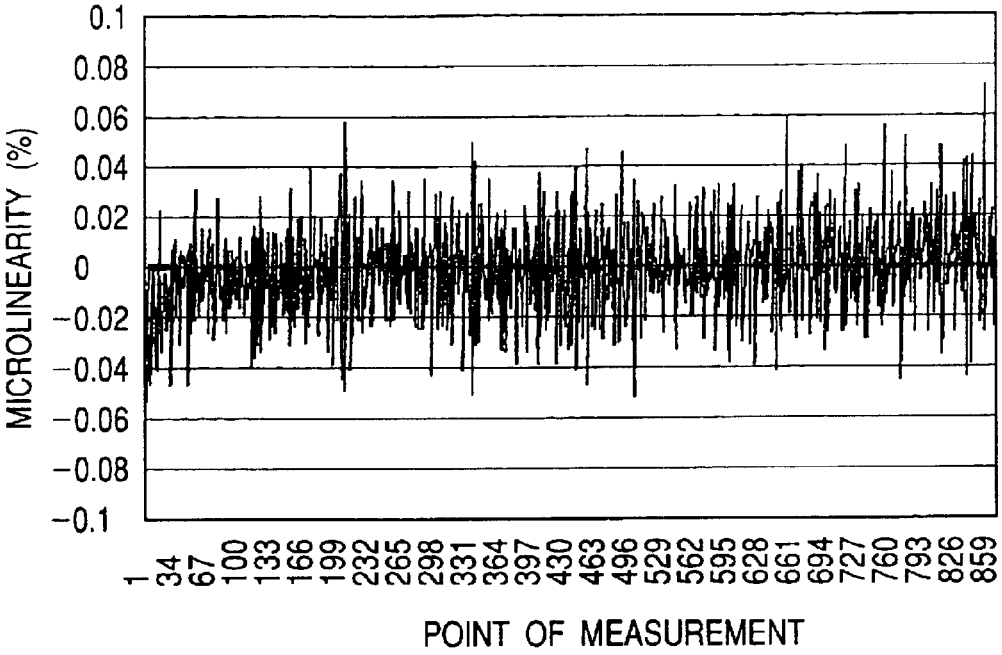
FIG. 9 is a graph showing the microlinearity of the resistor of Example 1 shown in FIG. 1 according to the present invention.
Figure 10:
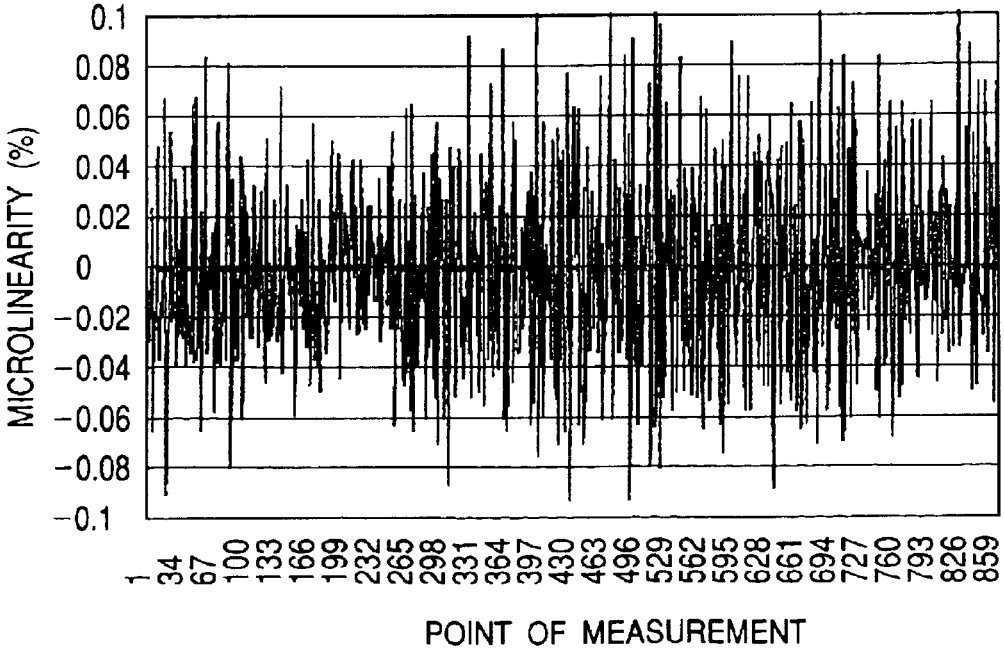
FIG. 10 is a graph showing the microlinearity of the resistor of Comparative Example 1 shown in FIG. 5.

FIG. 9 is a graph showing the microlinearity of the resistor of Example 1 shown in FIG. 1. FIG. 10 is a graph showing the microlinearity of the resistor of Comparative Example 1 shown in FIG. 5.

In the graphs of FIGS. 9 and 10, the abscissa indicates the points of measurement in the direction of rotation of the resistor. The ordinate indicates the microlinearity.

Figure 11:
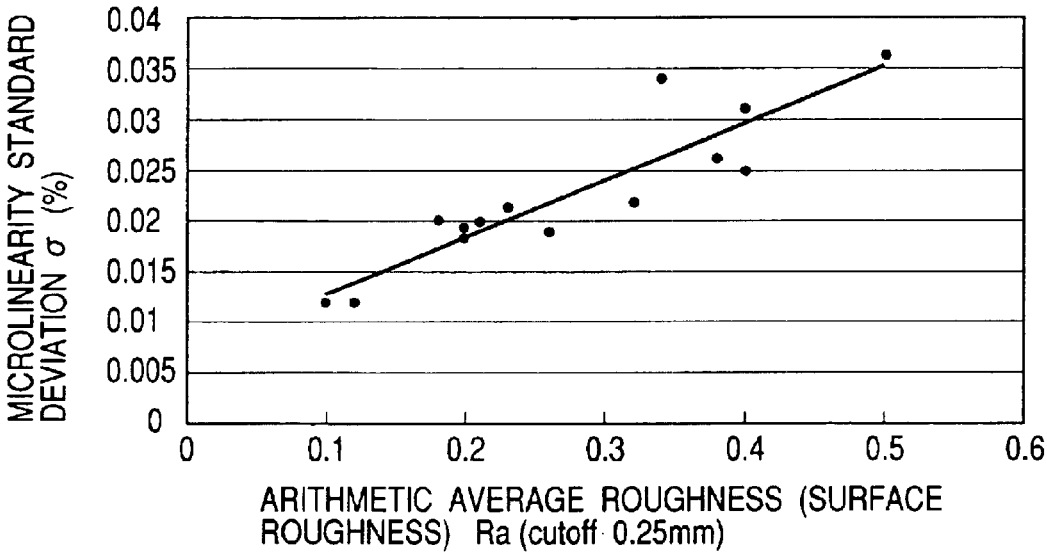
FIG. 11 is a graph showing the relationship between the surface roughness of the resistor and the microlinearity.
Figure 12:
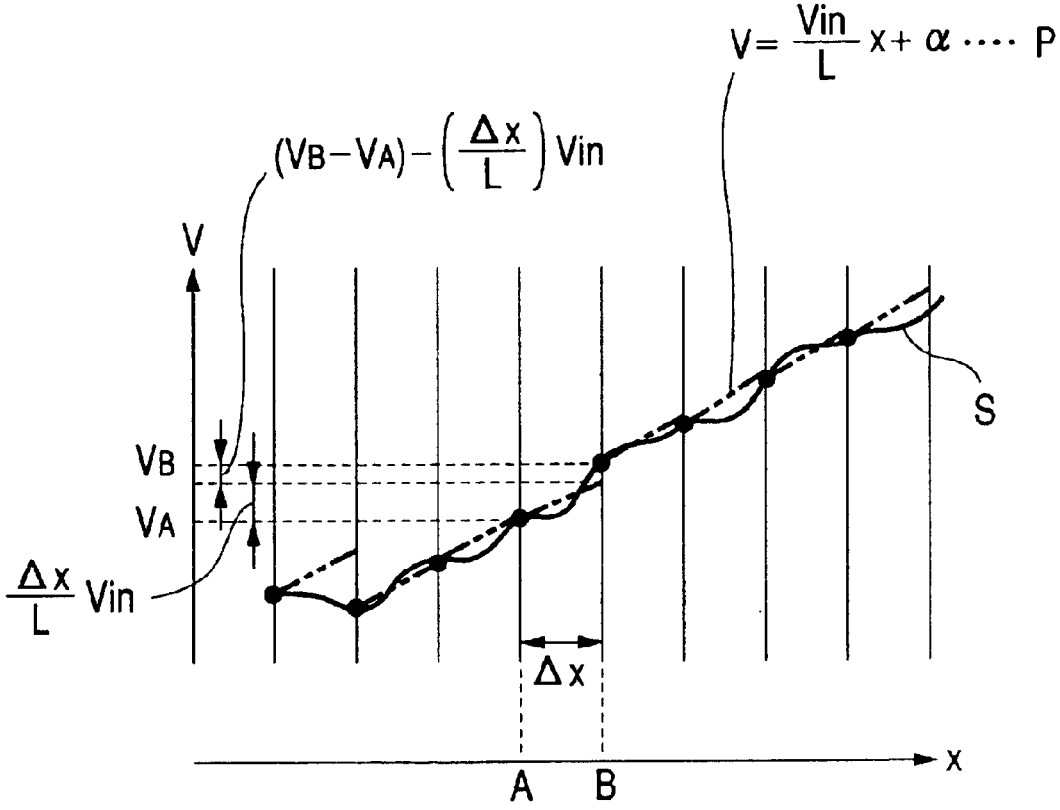
FIG. 12 is a graph that explains microlinearity.

FIG. 11 is a graph showing the relationship between the surface roughness of the resistor and the microlinearity. In the ordinate, σ indicates the microlinearity standard deviation at approximately 900 points of measurement on the surface of the resistor. The abscissa indicates the arithmetic average roughness (resistor surface roughness) Ra.

FIGS. 9 and 10 demonstrate that the resistor 1 of Example 1 has a microlinearity superior to that of the resistor 11 of Comparative Example 1.

FIG. 11 demonstrates that the standard deviation of the microlinearity increases as the arithmetic average roughness Ra increases. In other words, the arithmetic average roughness Ra is substantially proportional to the microlinearity. The microlinearity at each of the points of measurement increasingly deviates from the average value as the arithmetic roughness Ra increases.

Note that FIG. 11 is a graph for explaining the relationship between the arithmetic average roughness Ra and the microlinearity. In the graph, data other than those related to Examples and Comparative Examples described above are also plotted.

Table 3 shows the measured results of Examples and Comparative Examples regarding the surface roughness, the microlinearity, and the wear resistance of the resistor after sliding lifetime testing.

Table 4 shows the amounts of the second reinforcing material contained in the second resistive layer 4 of the resistor 1 (Example 1) shown in FIG. 1, and the sliding lifetime and printing quality of the resistor paste corresponding to these amounts. Note that the first resistive layer 3 at the bottom of the second resistive layer 4 contained pulverized carbon fibers (average particle size: 3 μm) as in Example 1.

TABLE 3

| | Particle size of first reinforcing material in the lower layer (μm) | Particle size of second reinforcing material in the upper layer (μm) | Surface roughness of resistor (μm) | Microlinearity | Sliding lifetime (wear resistance of resistor) |
|---|---|---|---|---|---|
| Example 1 | 3 | 0.35 | 0.20 Ra | Excellent | Excellent |
| Example 2 | 3 | 0.12 | 0.19 Ra | Excellent | Good |
| Example 3 | 3 | 0.90 | 0.25 Ra | Good | Excellent |
| Example 4 | 7 | 0.35 | 0.23 Ra | Excellent | Excellent |
| Example 5 | 3 | 0.4 | 0.21 Ra | Excellent | Excellent |
| Example 6 | 0.90 | 0.35 | 0.20 Ra | Excellent | Average to Good |
| Comparative Example 1 | dia: 8 fiber length: 30 | No reinforcing material | 0.50 Ra | Poor | Excellent |
| Comparative Example 2 | 3 | No reinforcing material | 0.18 Ra | Excellent | Poor |
| Comparative Example 3 | 3 | 3 | 0.38 Ra | Poor | Excellent |
| Comparative Example 4 | 0.35 | 0.35 | 0.20 Ra | Excellent | Poor to Average |

TABLE 4

| Amount of second reinforcing material (vol %) | Sliding lifetime (wear resistance of resistor) | Print quality of resistor paste |
|---|---|---|
| 3 | Poor to Average | Excellent |
| 5 | Good | Excellent |
| 7 | Excellent | Excellent |
| 10 | Excellent | Excellent |
| 20 | Excellent | Excellent |
| 25 | Excellent | Excellent |
| 30 | Good | Good |
| 35 | Average | Poor to Average |

In Tables 3 and 4, the evaluation "excellent" is given to highly preferable results, and "poor" is given to impracticably poor results. The term "average to good" indicates that the results are between "excellent" and "poor". The evaluation "average" is better than "poor" but inferior to "good". The evaluation "good" is between "excellent" and "average". Since the surface roughness Ra of the resistor is proportional to the microlinearity as shown in FIG. 11, in evaluating the microlinearity, "excellent" is given to a resistor having a surface roughness Ra of not more than 0.24 μm, and "good" was given to a resistor having a surface roughness Ra of not more than 0.3 μm. The wear resistance of a resistor was determined with a surface roughness/contour measuring instrument after sliding the sliding contact 50 million times. A resistor having a wear loss of less than 2.5 μm is rated "excellent", that having a wear loss of 2.5 μm or more but less than 3.5 μm is rated "good", that having a wear loss of 3.5 μm or more but less than 4.5 μm is rated "average", and that having a wear loss of 4.5 μm or more is rated "poor".

The evaluation of the print quality shown in FIG. 4 is conducted after the resistance paste is adjusted using an adequate diluting solvent according to the characteristics. If the print quality does not improve despite the adjustment or if the film applied by printing is not homogeneous, a low rating is given.

As shown in Table 3, the surface roughness Ra, i.e., the microlinearity, of the resistors of Comparative Examples 1 and 3 is poor. Regarding Comparative Example 1, this is presumably due to the fact that the particle size of the first reinforcing material in the lower layer is excessively large and that the second resistor layer at the top cannot sufficiently cover such a highly rough surface. Regarding Comparative Example 3, this is presumably due to the fact that the reinforcing material of the second resistor layer (upper layer) is as large as that of the lower layer, i.e., 3 μm. In Comparative Example 2, the second resistor in the upper layer was quickly worn out before 10 million times of sliding. Since a large amount of worn particles is generated in a short time, the contact resistance is likely to be large when such a resistor is put to a practical application. In Comparative Example 4, the particle size of the filler added to the first resistor (lower layer) as the reinforcing material is small; thus, the overall strength of the resistor is insufficient, and sliding lifetime is short.

Moreover, as shown in Table 3, the resistors of Examples 1 to 6 having the upper layer composed of the second resistor paste containing the second reinforcing material have superior microlinearity although the surface roughness thereof is at the same level as that of the resistor (e.g., Comparative Example 2) without the reinforcing material. As Comparative Example 4 shows, addition of the second reinforcing material having an average particle size of 0.35 μm alone does not achieve sliding lifetime of 50 million times. However, the sliding lifetime of Comparative Example 4 is longer than that of Comparative Example 2 containing no reinforcing material in the upper layer. When Example 1 is compared with Comparative Example 2 having the same first resistor layer (lower layer), Example 1 having the upper layer containing the second reinforcing material having an average particle size of 0.35 μm exhibits significantly longer sliding lifetime than Comparative Example 2 containing no reinforcing material in the upper layer. This fact shows that the sliding lifetime is prolonged by addition of the reinforcing material in the upper resistor layer on which the sliding contact moves. A comparison of Example 1, Example 6, and Comparative Example 4 shows that the sliding lifetime increases with the particle size of the first reinforcing material in the lower layer. Thus, the combination of the lower layer, i.e., the first resistive layer 3, containing the first reinforcing material having a large particle size as in Examples 1 to 6 and the upper layer, i.e., the second resistive layer 4, containing the second reinforcing material having a small particle size achieves both superior microlinearity and wear resistance, which are originally incompatible characteristics.

In other words, both high microlinearity and superior wear resistance can be achieved by adding the first reinforcing material that improves the sliding lifetime to the first resistor paste for forming the first resistive layer 3, i.e., the lower layer and by adding the second reinforcing material that has a particle size optimum for reducing the surface roughness Ra of the resistor to the second resistor paste for forming the second resistive layer 4, i.e., the upper layer.

Note that when the amount of the first reinforcing material is less than 3 vol % of the total volume of the first resistive layer 3, i.e., the lower layer, the first reinforcing material does not exhibit sufficient reinforcing effects. When the amount exceeds 30 vol %, the resulting resistor paste is not suitable for application by printing; moreover, the first resistive layer 3 becomes fragile, resulting in shorter sliding lifetime. Thus, the amount of the first reinforcing material is preferably 3 to 30 vol %, and more preferably 6 to 20 vol %.

Table 4 shows that, in the resistor 1 of Example 1 shown in FIG. 1, the amount of the second reinforcing material in the total volume of the second resistive layer 4, i.e., the upper layer, after curing needs to be in the range of 5 to 30 vol %, and more preferably 7 to 25 vol %.

When the amount of the second reinforcing material is less than 5 vol %, the second reinforcing material does not exhibit sufficient reinforcing effects. When the amount of the second reinforcing material exceeds 30 vol %, the resulting resistor paste is not suitable for application by printing; moreover, the resistor becomes fragile, resulting in degradation in wear resistance.

Table 3 shows that the preferable range of the arithmetic surface roughness Ra of the resistor 1 is not more than 0.3 $\mu$m, and more preferably not more than 0.24 $\mu$m in order to achieve superior microlinearity.

The thickness of the resistor layer at the top, i.e., the upper layer, is preferably large enough to planarize the irregularities in the surface of the resistor layer at the bottom to allow the resistor 1 to have the desired surface roughness Ra described above.

What is claimed is:

1. A variable-resistance element comprising a resistor and a sliding contact that slides on a surface of the resistor, the resistor comprising:

a first resistor layer comprising carbon black and a first reinforcing material dispersed in a binder resin; and a second resistor layer comprising carbon black and a second reinforcing material dispersed in a binder resin, the second reinforcing material having a smaller average particle size than the first reinforcing material, wherein the second resistor layer is disposed on the first resistor layer, wherein the average particle size of the second reinforcing material is not less than 0.1 $\mu$m but less than 1 $\mu$m, wherein the second reinforcing material comprises spherical particles, wherein the second resistor layer comes into contact with the sliding contact, and wherein the second reinforcing material is thermal black.

2. The variable-resistance element according to claim 1, wherein the content of the second reinforcing material in the second resistor layer is 5 to 30 percent by volume.

3. The variable-resistance element according to claim 1, wherein the average particle size of the first reinforcing material is in the range of 1 to 10 $\mu$m.

4. The variable-resistance element according to claim 3, wherein the first reinforcing material comprises pulverized carbon fibers.

* * * * *